US005435657A

United States Patent [19]

Pearce et al.

[11] Patent Number: 5,435,657

[45] Date of Patent: Jul. 25, 1995

[54] LABEL PRINTER AND TAPE AND INK RIBBON CARTRIDGE FOR USE THEREIN

[75] Inventors: Edwin M. Pearce, San Francisco; Rickson Sun, Palo Alto, both of Calif.

[73] Assignee: Smith Corona Corporation, Cortland, N.Y.

[21] Appl. No.: 174,936

[22] Filed: Dec. 28, 1993

[51] Int. Cl.[6] ..... B41J 35/28

[52] U.S. Cl. ..... 400/208; 400/194; 400/223; 400/242; 400/247; 400/586; 400/587; 400/602

[58] Field of Search ..... 400/196, 196.1, 207, 400/208, 208.1, 223, 225, 233, 234, 621, 185, 186, 192, 194, 221, 221.1, 242, 247, 602, 613, 614, 615.1, 586, 587, 590, 592, 593, 594, 594.1

[56] References Cited

U.S. PATENT DOCUMENTS

| | | | |
|---|---|---|---|
| 3,643,779 | 2/1972 | Anderson et al. | 400/208 |
| 3,804,227 | 4/1974 | Cappotto et al. | 400/208 |
| 4,440,977 | 4/1984 | Pao et al. | 400/120 |
| 4,647,235 | 3/1987 | Sato | 400/120 |
| 4,815,875 | 3/1989 | Richardson et al. | 400/208.1 |
| 4,832,514 | 5/1989 | Basile | 400/120 |
| 4,836,697 | 6/1989 | Plotnick et al. | 400/120 |
| 4,917,514 | 4/1990 | Richardson et al. | 400/120 |
| 4,930,913 | 6/1990 | Basile | 400/120 |
| 4,966,476 | 10/1990 | Kuzuya et al. | 400/208 |
| 4,973,983 | 11/1990 | Yamamoto et al. | 400/208 |
| 5,022,771 | 6/1991 | Paque | 400/120 |
| 5,041,845 | 8/1991 | Ohkuzo et al. | 400/621 |
| 5,056,940 | 10/1991 | Basile | 400/120 |
| 5,073,052 | 12/1991 | Daley et al. | 400/208 |
| 5,078,523 | 1/1992 | McGourty et al. | 400/613 |
| 5,174,670 | 12/1992 | Takagi et al. | 400/621 |
| 5,188,469 | 2/1993 | Nagao et al. | 400/208 |
| 5,308,173 | 5/1994 | Amano et al. | 400/88 |

FOREIGN PATENT DOCUMENTS

| | | | |
|---|---|---|---|
| 0336540 | 10/1989 | European Pat. Off. | 400/208 |
| 0555942 | 8/1993 | European Pat. Off. | 400/208 |
| 0241178 | 10/1986 | Japan | 400/208 |
| 0273976 | 12/1986 | Japan | 400/208 |
| 0187060 | 8/1987 | Japan | 400/208 |
| 4062163 | 2/1992 | Japan | 400/208 |

*Primary Examiner*—Eugene H. Eickholt

[57] ABSTRACT

A thermal printing device comprises a label tape printer and tape and ink ribbon cartridge for horizontal insertion into the printer. The cartridge housing includes an upper cover and a base which are joined by telescoping hubs and posts. The cartridge contains a supply of tape and ink ribbon wound on supply spools, a ribbon or rewind spool and a roller platen all supported for rotation. The platen and the rewind spool are formed with gears which engage one another. The platen gear is disposed proximate the cartridge tape port and an opening for admitting the printer print head. When the cartridge is horizontally inserted :into a printer openings the print head bears against the tape and ink ribbon which abuts the platen for controlled printing and advancement of the tape and ribbon. The platen gear partially extends from the front of the cartridge for driving engagement with a printer motor drive gear. In an alternate embodiment the rewind spool gear engages the printer motor drive gear.

58 Claims, 7 Drawing Sheets

LABEL PRINTER AND TAPE AND INK RIBBON CARTRIDGE FOR USE THEREIN

BACKGROUND OF THE INVENTION

1. Field of the Invention

The present invention relates generally to tape printing devices such as label printers and more particularly pertains to improved label printers, which print alphanumeric characters on a strip of tape and which employ readily replaceable cartridges containing an ink ribbon and a tape strip.

2. Description of the Prior Art

Printing devices such as label tape printers are constructed to enable printed characters to be impressed on a strip of tape. Early such tape printers used print wheel disks having raised characters thereon and were of the "spin and print" manual form wherein the wheel disk was manually rotated to locate the desired character to be printed at the print point. These impact tape printing machines were subsequently modified to be keyboard operated as are typewriters. Such early impact printing devices tended to be large, heavy, cumbersome and slow. These devices have recently been replaced by printers based on thermal printing technology. Present thermal transfer printing uses a heat generating print head having an array of heatable wire pins. By selectively heat activating specific pins to form a sequence of pixels, various printable characters are formed on the ink ribbon for final transfer to a tape strip.

Label tape printers of this type are generally provided with cartridges that contain both the ink ribbon and the tape strip. It is, of course, desirable that such cartridges be readily removable when either the ink ribbon or the tape therein have been depleted and be readily insertable when a fresh cartridge is to be used. In some presently available label tape printers the printing and driving apparatus of the printer device are attached to the printer and removal and reloading of the cartridge requires their disengagement. Such procedure is both complicated and time consuming and in some instances requires the initial opening of the printer and/or cartridge cover to permit the release of the drive means and print head from the cartridge. For these reasons, it is desirable to provide a tape printer and a cartridge therefor in which the cartridge may be readily removed and a new cartridge readily replaced without any complex and time consuming effort.

In known prior art label printers, the tape and ink ribbon cartridge is vertically inserted. In such devices, the print head, and/or feed roller, and/or platen must be displaced to an inoperative position in order to provide clearance for locating and aligning the tape and ink ribbon cartridge in its print and feed positions. Thereafter the print head, feed roller and platen had to be returned to their operative positions. This procedure necessitates time consuming effort and manipulation on the part of the operator.

An example of a prior art label tape printing device incorporating vertical loading of the ribbon and tape cartridge and structure for releasing the print head and drive from the cartridge is U.S. Pat. No. 4,647,235 which discloses a cartridge for a thermal printer that includes a platen and feed rollers for advancing the tape. The prior art devices disclosed in U.S. Pat. Nos. 4,832,514 and 4,836,697 include tape cartridges that are vertically inserted and then moved upon closure of the cover into operative position in the printer housing.

U.S. Pat. Nos. 4,930,913, 4,917,514 and 5,022,771 disclose label tape printers which include vertically directed drive spindles and posts for cooperation with rotatable hubs within the cartridge for controlling and advancing the ribbon and tape within the cartridge. U.S. Pat. No. 5,056,940 discloses a label tape printer device which includes a pivotable cover for closing over and operatively positioning a vertically insertable cartridge. The ink ribbon and tape are advanced by a pair of drive rollers one of which is a part of the printer device and the other is contained within the cartridge. U.S. Pat. No. 4,815,875 discloses structure similar to the above patent but further includes a receiving tray for supporting and positioning the cartridge in its print transfer alignment position. U.S. Pat. No. 5,078,523 discloses a thermal tape printing machine which comprises a cassette receiving area formed as a recess in the rear wall of the printing machine. The recess includes a vertical surface through which extend a print head, a platen, a cassette lock, and a guide pin as well as other elements all for engagement with coacting internal parts of the cassette when the cassette is inserted into the recess.

U.S. Pats. Nos. 3,643,779 and 3,804,227 which relate to typewriters and cartridges therefor disclose laterally insertable typewriter cartridges for feeding ink ribbon to and from an external typewriter print point. The cartridge disclosed does not include a platen nor a tape nor can it accept a print head for internal printing.

SUMMARY OF THE INVENTION

The present invention comprises a label tape thermal printing device and a tape and ink ribbon cartridge for use therewith. The printing device may include a keyboard and a screen for viewing keyboard input and messages. The device is provided with a horizontal lateral opening for receiving the tape and ink ribbon cartridge and for supporting the cartridge for thermal transfer printing. The printing device is also provided with a print head and associated printing controls. The print head is operatively interfaced with a platen rotatably supported within the cartridge.

The cartridge comprises an upper cover and a lower base and contains a supply of label tape and ink ribbon, a platen having a gear thereon, a tape supply spool, an ink ribbon supply spool, and an ink ribbon rewind spool having a gear thereon. These rotatable structures are suitably carried by appropriate hubs formed in the base or cover. In one embodiment, the platen gear extends outwardly in a lateral direction from the front of the cartridge into engagement with a printer drive gear for rotation of the platen and the ink ribbon take-up spool to which the platen gear is coupled. In another embodiment, the ink ribbon rewind spool gear extends outwardly in a lateral direction from the front of the cartridge into engagement with the printer drive gear for rotation of the ink ribbon take-up spool and the platen to which the ink ribbon take-up spool is coupled. Cooperating elements are formed opposite these hubs and telescope therein when the cover and base are joined to provide a stable aligned housing structure. The cartridge is formed with an outer notch for latching engagement with a latch in the opening in the printer device when the cartridge is inserted into the printer device. The cartridge is further provided with an exit port for the tape and an opening through which the printer print head extends into the cartridge. The thermal print head is biased against the platen and the interposed ink ribbon and tape.

In the first embodiment when the cartridge is horizontally inserted into the printer device the platen gear engages the printer drive means. During the thermal printing operation in the first operation, rotation of the platen gear by the printer drive means advances both the tape and the ink ribbon since the rewind spool is coupled to the platen drive gear. In the alternate embodiment the printer drive means is coupled to rotate the gear carried by the rewind spool which in turn engages and drives the platen gear.

Since the platen is contained in the replaceable cartridge, there is no need for cleaning and maintaining the platen as is the case in the prior art devices wherein the platen is located in the printer. Should the platen in the cartridge become inoperable, a fresh cartridge may be readily inserted in its place. In contrast, an inoperable platen in the prior art label printers will cause the entire printer to be inoperable. Further, lateral insertion of the cartridge eliminates the requirement that the print head, tape feed roller and platen be moved between operative and inoperative orientations. In addition, lateral insertion further eliminates the need, present in certain prior art printers, to position the cartridge printer upside down to open a door in the printer base in order to change the cartridge. Additionally, the present invention eliminates the need for operating levers or moving covers to load and reload cartridges and the need for accurate alignment and positioning of the cartridge.

Accordingly, it is an object of this invention to provide a low cost, reliable, improved thermal tape printing device adapted for use with a horizontally insertable tape and ink ribbon cartridge for imprinting desired characters on a strip of tape.

Another object of this invention is to provide a simple, compact, reliable tape and ink ribbon cartridge which includes a platen located therein.

Another object of the present invention is to provide a tape and ink ribbon cartridge which includes means for driving engagement with a printer device drive means to advance the tape and ink ribbon.

A still further object is to provide a tape and ink ribbon cartridge including means for cooperating with a latch means carried in the opening of a printer device.

Still another object of the present invention is to provide a tape and ink ribbon cartridge having an improved coupling and drive system. Other objects and many of the attendant advantages of this invention will be readily appreciated as the same become better understood by references to the following detailed description when considered in connection with the accompanying drawings in which like references numerals designate like parts throughout the figures thereof.

DETAILED DESCRIPTION OF THE PREFERRED EMBODIMENTS

Figure 1:
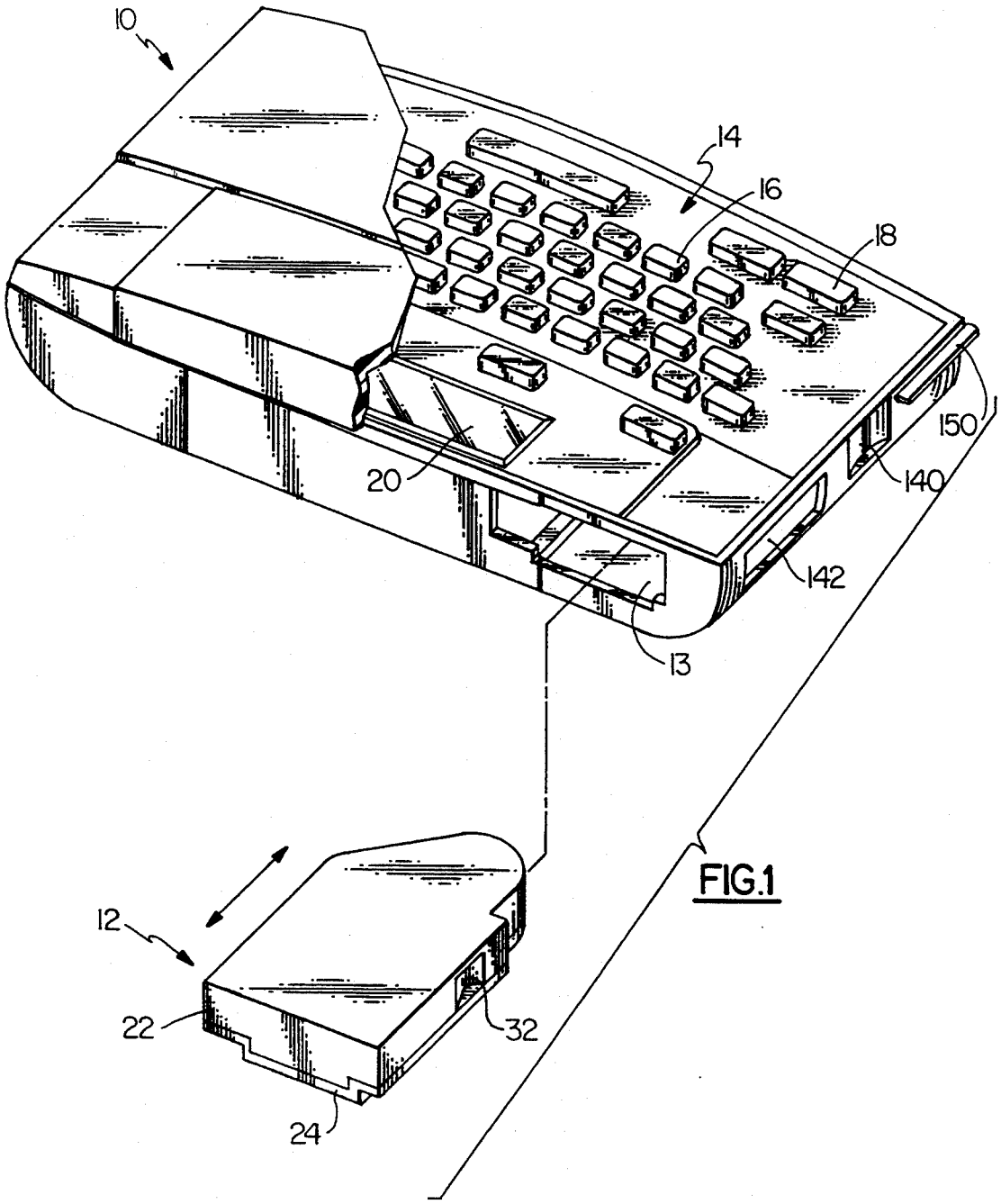
FIG. 1 is a perspective view of the label tape printer of the present invention.

In the illustrated embodiment of FIG. 1 a thermal label tape printer 10 is shown with a tape and ink ribbon supply cartridge 12 for inserting into a cartridge opening 13 of the tape printer 10. The printer includes a keyboard portion 14 having a plurality of print character keys 16 and operation control keys 18. The tape printer 10 further includes a monitor screen 20 which enables the operator to view the keyed inputs and any prompts and messages indicated by the printer device.

The printer device may include, in addition to other various parts, a thermal printer head, a motor for advancing both the tape and ink ribbon contained in the cartridge, and a structure for receiving and retaining the cartridge. An operator, in using the printer device, first selects a mode of operation and then activates the desired input character keys to produce a desired series of characters for imprinting on a tape.

Figure 2:
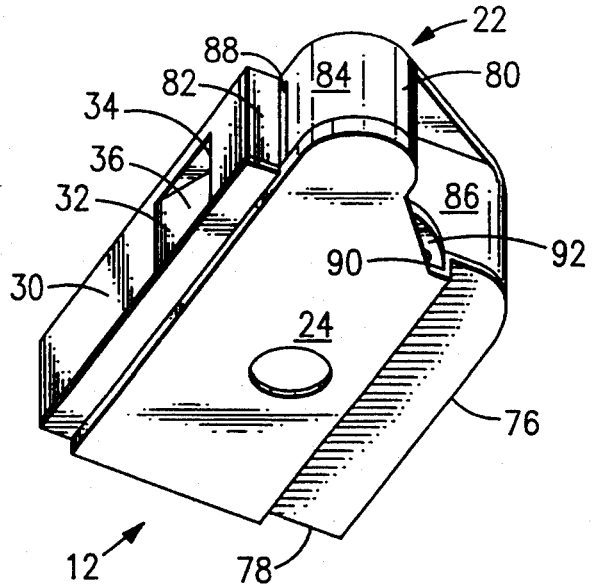
FIG. 2 is a bottom perspective view of a tape and ink ribbon cartridge made in accordance with the present invention.
Figure 3:
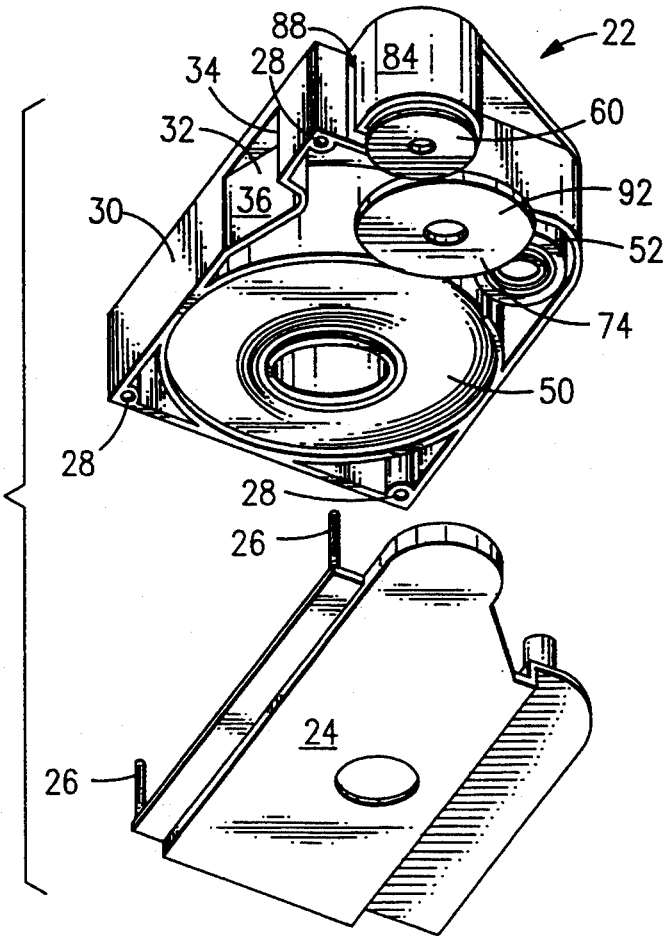
FIG. 3 is a partially exploded perspective view of the cartridge of FIG. 2 showing the cartridge cover and base.
Figure 4:
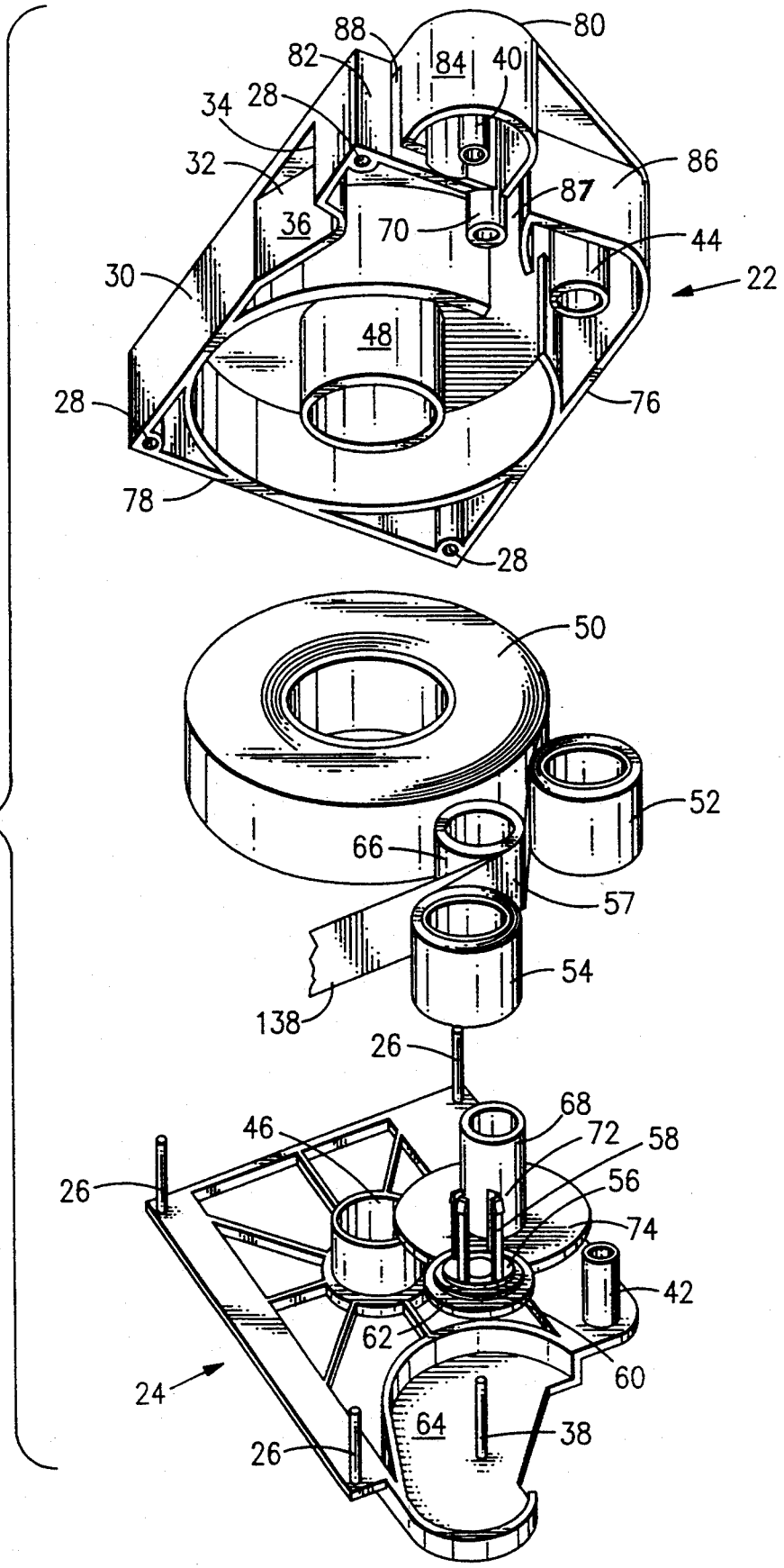
FIG. 4 is a fully exploded perspective view of the cartridge of FIG. 2.

Referring now to FIGS. 2, 3 and 4, the cartridge 12 includes a cartridge cover 22 which is joined to a cartridge base 24 to form a housing therebetween. Upstanding retaining and aligning posts 26 formed on the base 24 are received into corresponding recesses 28 in the cover 22 when the cover 22 is joined to the base 24. A cartridge side wall 30 is formed with an inwardly directed notch portion 32 defined by a forward abutment wall 34 and a camming wall 36.

Figure 6:
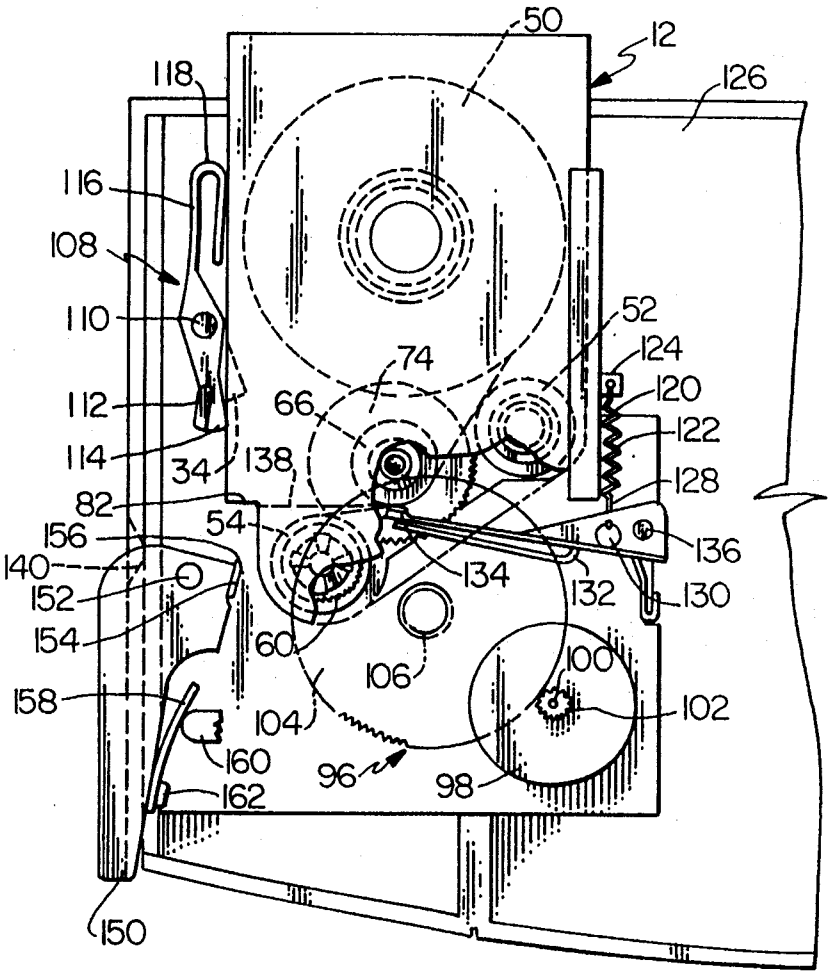
FIG. 6 is a top view similar to FIG. 5 showing the cartridge partially ejected from the label tape printer.

The cartridge base 24 carries an integral upstanding post 38 which is positioned to seat and telescope into a corresponding rewind spool hub 40 formed in the cover 22. Likewise, an upstanding stud 42 is disposed to telescopingly seat into a supply spool hub 44. A base hub 46 is positioned to mate with an integral cover hub 48. The post 38, hub 42 and hub 46 seat within their corresponding hubs 40, 44, and 48 to provide a relatively rigid and stable cartridge assembly. A label tape supply spool 50 is rotatably carried on the cover hub 48 and an ink ribbon supply spool 52 is rotatably mounted on the supply spool hub 44. A rewind spool 54 is mounted on a forked hub 56. An ink ribbon 57 extends between the supply spool 52 and the rewind spool 54. The forked hub 56 is supported for rotation on the rewind spool hub 40. The forked hub 56 is formed with a plurality of extending flexible fingers 58 and includes a rewind gear 60 integrally formed thereon. Disposed below the rewind gear 60 is a hub base 62 which rests on a surface 64 of the base 24 to position the rewind gear 60 above and spaced from the base 24. A roller platen 66 is rotatably mounted on a platen hub 68. The platen hub 68 seats on an opposed post 70 formed on the cover 22. The opposite end 72 of the platen hub 68 terminates in a platen gear 74 which is in rotary driving engagement with the rewind gear 60 (FIGS. 5 & 6).

The flexible fingers 58 act as a slip clutch so that if the ink ribbon 57 becomes excessively taut, damage to the ink ribbon 57 and to the rewind gear 60 is prevented. Tightening of the ink ribbon 57 can occur due to the progressive increase in diameter of the ink ribbon 57 would onto the rewind spool 54 by a constant drive rate of the rewind gear 60. When the ink ribbon 57 becomes excessively taut, the rewind spool 54 will slip against the flexible fingers 58.

The overall configuration of the cartridge 12 is defined by its peripheral walls which include side walls 30 and 76, a rear wall 78, and a front wall 80. The front wall 80 includes a step wall portion 82, an arcuate wall 84 which encloses the hub 40, and a second step wall portion 86. The arcuate wall 84 and the step wall portion 82 terminate proximate each other but are slightly spaced apart to provide a cartridge port 88 through which a strip of the tape 50 may exit the cartridge 12. The cartridge 12 is formed with a space 90 (FIG. 2) between the cover 22 and the base 24 near the second step wall portion 86 to permit a portion 92 of the platen gear 74 to extend outwardly of the cartridge 12.

Figure 5:
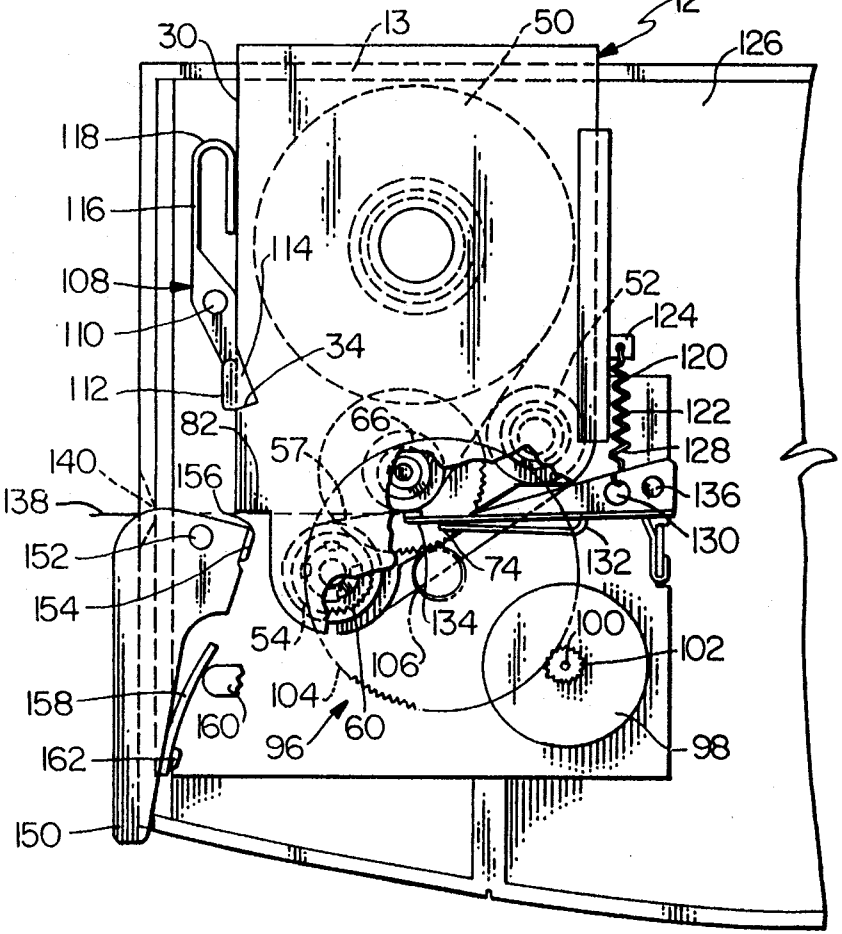
FIG. 5 is a top view of the cartridge of FIG. 2 in its operative position when inserted into the label tape printer.
Figure 7:
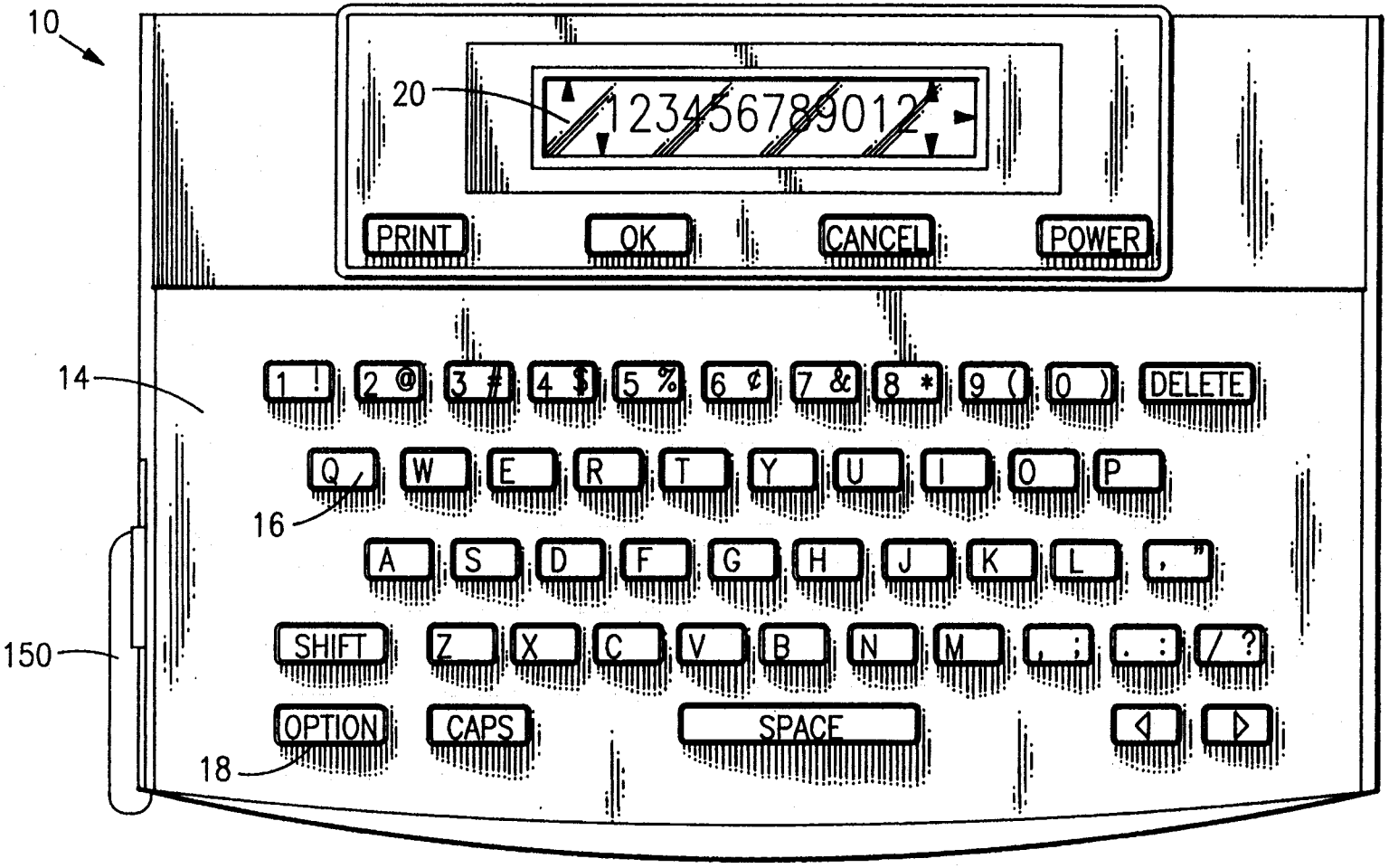
FIG. 7 is a top plan view of the label tape printer.

Referring now to FIG. 5 where there is shown a gear drive train assembly 96 which includes a D.C. motor 98, such as model number M34E-5C, manufactured by Mitsumi Electric Co. of Tokyo, Japan. A motor shaft 100 carries a pinion gear 102 that drivingly engages an intermediate idler gear 104. The idler gear 104 is integrally formed with an idler pinion gear 106. The aforementioned gear drive train assembly 96 includes components, namely, the pinion gear 102, motor 98, the idler gear 104 and the idler pinion gear 106 which are all mounted on and form a part of the tape printer 10.

When the cartridge 12 has been laterally inserted to its operative position (FIG. 5) the intermediate idler pinion gear 106 engages the platen gear 74 which, in turn, meshes with the ribbon rewind spool gear 60 to complete the drive coupling from the motor 98 to impart stepwise rotation to the roller platen 66 and the rewind spool 54.

A latch 108 is pivotally supported about a pivot 110 in the label tape printer 10 proximate the opening 13 into which the cartridge 12 is inserted. One end 112 of the latch 108 includes a latching portion 114. Its opposite end 116 is formed with an integrally formed finger actuator 118 for biasing the latch 108 in a counter clockwise direction to position the latching portion 114 into the path of the cartridge side wall 30 upon insertion of the cartridge 12. The latching portion 114 bears against the cartridge side wail 30 until it enters the notch portion 32 where it engages the camming wall 36 and terminates against the abutment wall 34 to align and retain the cartridge 12 in the tape printer opening 13.

One end 120 of a print head bias spring 122 is connected to a spring anchor 124 on a label tape printer housing 126. The opposite end 128 of the bias spring 122 is seated in a print head aperture 130 on a print head assembly 132. The bias spring 122 biases a print head 134 about a pivot 136 to abut through port opening 97 of cartridge 12 against a tape 138 and the ink ribbon 57 disposed intermediate the print head 134 and the roller platen 66. Circuitry in the tape printer 10 drives the roller platen 66 to advance the tape 138 and the ink ribbon 57 and to successively energize the pixels defining the characters inputted by the operator as the tape 138 and the ink ribbon 57 advance past the print head 134. In effect, the appropriate heat elements of the thermal print head 134 are energized so as to transfer the inputted characters from the ink ribbon 57 to the tape 138 as the tape 138 and the ink ribbon 57 advance past the print head 134. The leading end of the tape 138 exits through the cartridge port 88 and then through a port 140 formed in the tape printer 10. The used ink ribbon 57 winds onto the rewind spool 54. One suitable thermal print head for use herein is the print head manufactured under model number NV4818-YA by ROHM of Kyoto, Japan.

The pressing action of the print head 134 against the roller platen 66 biases the entire cartridge 12 outwardly of the opening 13 (FIG. 6). Therefore, when the operator wishes to remove the cartridge 12 from the tape printer 10, it is only necessary to depress the latch 108. An opening 142 formed in the housing 126 provides access for the operator to depress the latch 108. A tape cutter lever 150 is pivotably mounted on a post 152 on the tape printer 10. A blade 154 is attached to the lever 150 and has a cutting edge 156 thereon. Referring to FIG. 5 with the cartridge 12 located in its operative position, the operator can pivot the lever 150 counterclockwise about the post 152. The cutting edge 156 will first press the tape 138 against the step wall portion 82 of the cartridge 12 and then cut the tape 138 from the tape supply spool 50. The step wall portion 82 is used as a backing surface for the cutting action. When the operator releases the lever 150, a leaf spring 158 abutting against a wall 160 formed in the housing 126 will pivot the lever 150 clockwise to remove the cutting edge 156 from the step wall portion 82. The leaf spring 158 is rigidly attached to the lever 150 by a rivet 162. If the cutting edge 156 becomes too dull to efficiently cut the tape 138, the blade 154 may be removed from the lever 150 by conventional means such as a screw (not shown) and replaced with a new blade 154. Alternatively, the blade 154 may be riveted to the lever 150 and the combined lever 150 and blade 154 may be replaced. The step wall portion 82 being formed integral with the cartridge cover 22 will automatically be replaced when each new cartridge 12 is inserted into the tape printer 10.

Figure 8:
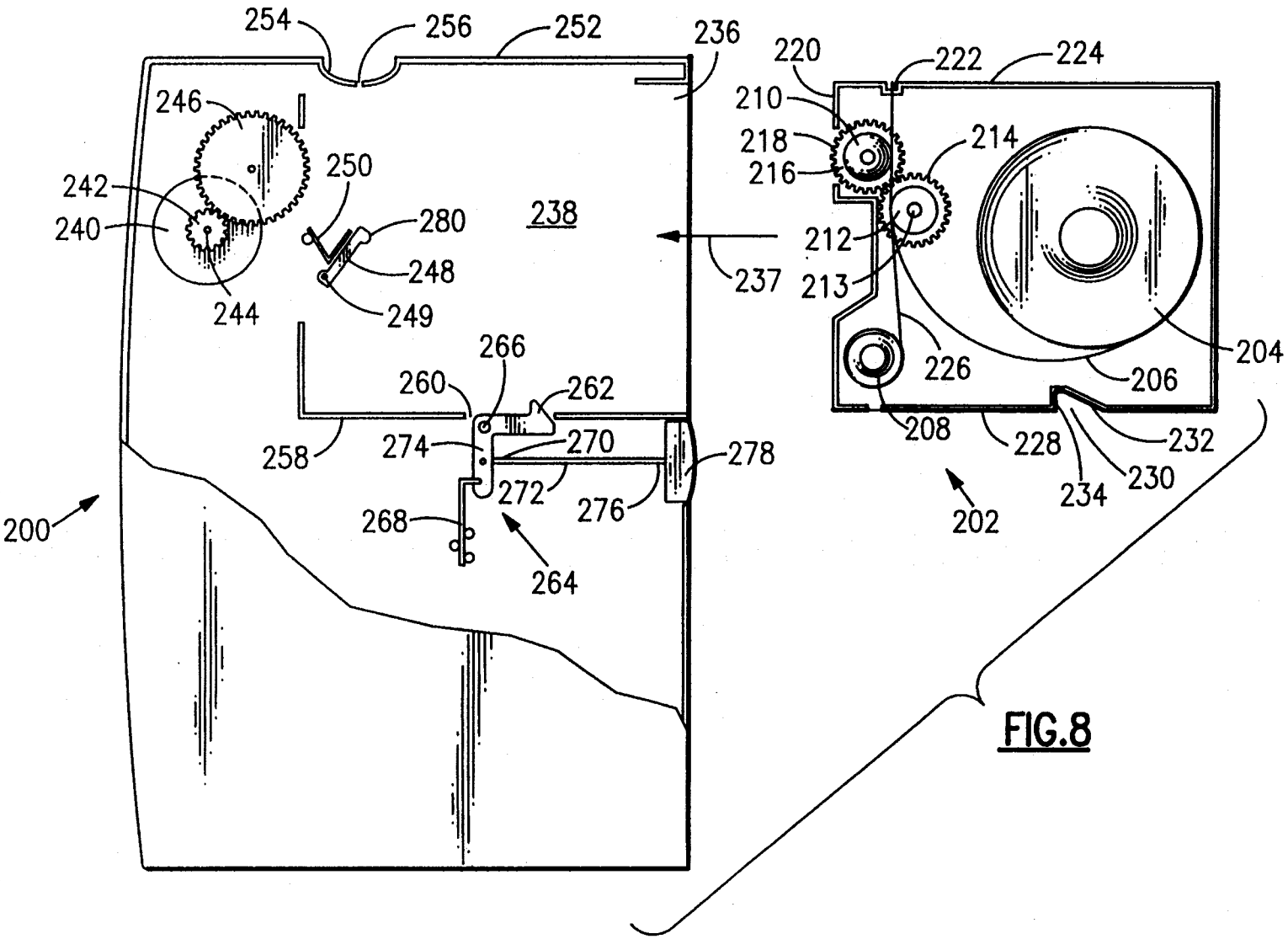
FIG. 8 is a partial top plan view of a label tape printer and a tape and ink ribbon cartridge aligned for horizontal loading into the printer of an alternate embodiment.
Figure 10:
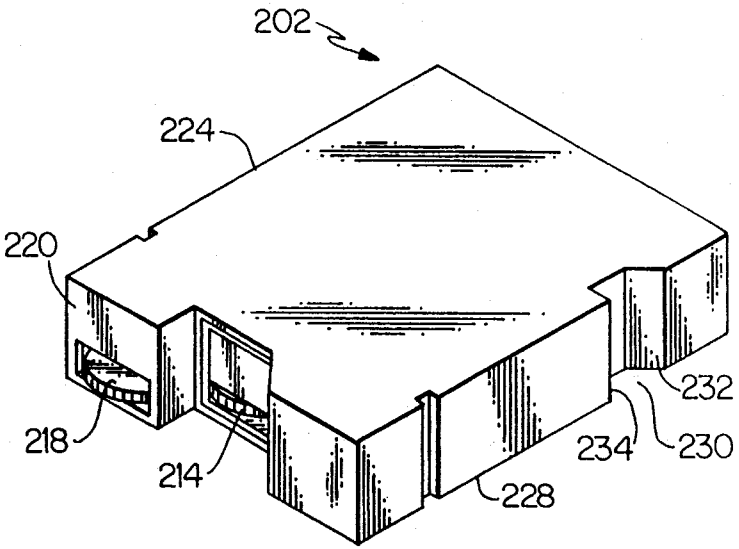
FIG. 10 is a top perspective view of the cartridge of FIGS. 8 and 9.
Figure 9:
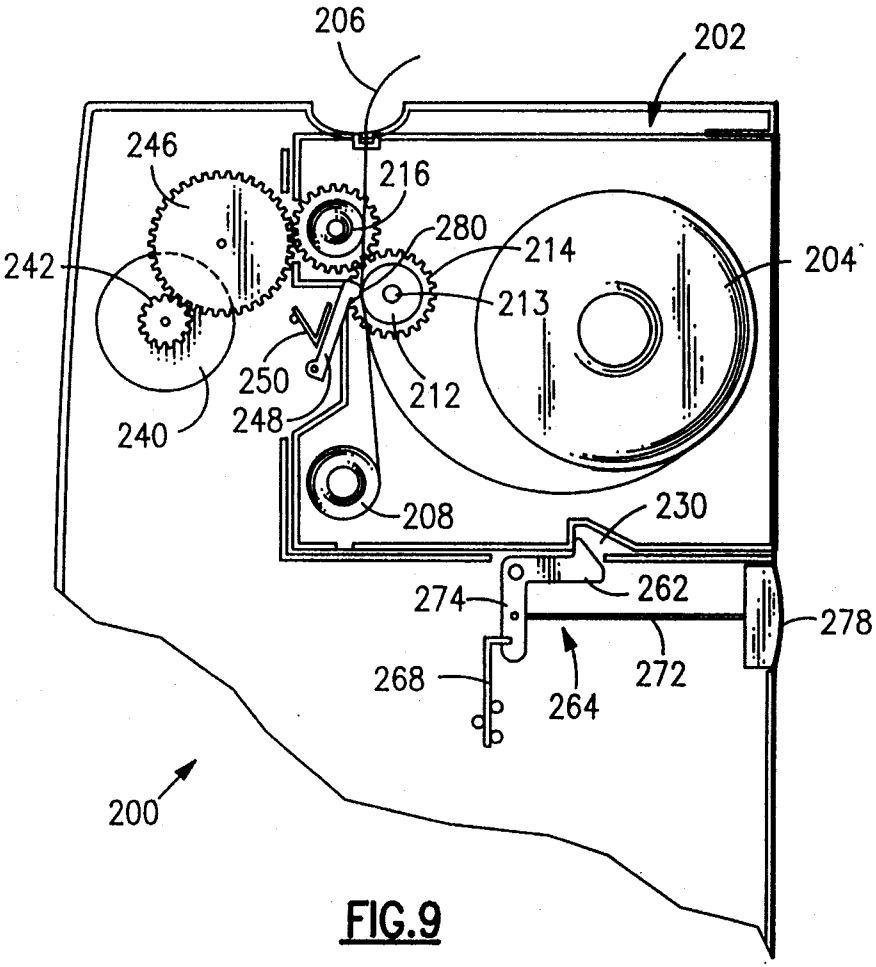
FIG. 9 is a partial top plan view of the label tape printer of FIG. 8 with the cartridge in its operative position.

An alternate embodiment of the present invention is illustrated in FIGS. 8, 9 and 10. FIG. 8 shows that portion of a label tape printer 200 which receives a tape and ink ribbon cartridge 202. The cartridge 202 contains therein a tape supply spool 204 on which is wound a tape 206, an ink ribbon supply spool 208, an ink ribbon rewind spool 210 and a roller platen 212. The roller platen 212 pivots about post 213 and rigidly supports a platen drive gear 214 which is positioned for meshed engagement with a rewind gear 216 mounted on the rewind spool 210. A portion 218 of the rewind gear 216 extends outwardly of a cartridge front wall 220. The tape 206 extends from the tape supply spool 204 and passes against and in front of the roller platen 212 and into a port 222 of a cartridge sidewall 224. An ink ribbon 226 follows a path so as to pass from the ink ribbon supply spool 208 in front of the roller platen 212 and wound onto the rewind spool 210. An opposite cartridge sidewall 228 is formed with a notch 230 that includes a cam surface 232 and an abutment 234.

Referring now specifically to FIG. 8, the tape printer 200 is formed with a lateral opening 236 through which the cartridge 202 loads into the tape printer 200 in a direction shown by an arrow 237 and is slidingly supported on a shelf 238. A D.C. motor 240 is mounted in the tape printer 200 opposite the opening 236 and supports a pinion gear 242 on a motor shaft 244. A drive gear 246 is coupled to the pinion gear 242 for rotation therewith. A thermal print head 248 is mounted to pivot about a mount 249 under the bias force exerted by a print head spring 250. A printer sidewall 252 is formed with an inwardly directed arcuate portion 254 which includes a central slot 256. An opposite sidewall 258 is formed with a latch opening 260 for permitting a latch head 262 to extend into the opening 236. A latch 264 is pivotally supported about a pivot 266 and is biased in a counter clockwise direction by a latch spring 268. One end 270 of a rod 272 is attached to a lower arm 274 of the latch 264. The other end 276 of the rod 272 terminates in a button 278 which is accessible from the exterior of the tape printer 200.

During initial insertion of the cartridge 202 into the opening 236 of the tape printer 200 (see FIG. 9), the latch 264 is deflected against the force of the spring 268 by the cartridge sidewall 228. Cartridge insertion continues until the rewind gear 216 engages the drive gear 246 and the latch head 262 enters the notch 230 to fixedly position the cartridge 202 within the tape printer 200. The engaged gears effectively couple the drive of the motor 240 to both the ink ribbon rewind spool 210 and the roller platen 212. The print head spring 250 biases a thermal print head portion 280 in the direction of the roller platen 212 so as to bear against the ink ribbon 226, the tape 206 and the roller platen 212. Under this print head bias pressure, rotation of the roller platen 212 advances the tape 206 and the ink ribbon 226 in a direction to cause the tape 206 to exit through the cartridge port 222 and the label printer central slot 256 after the tape 206 has been thermally imprinted.

When it is desired to remove the cartridge 202 from the tape printer 200, it is only necessary to push a button 278 to release the latch 264 and retract the latch head 262 from the notch 230. Upon release of the latch head 262, the biasing force of the print head 248 against the roller platen 212 moves the cartridge 202 partially outwardly through the opening 236. It is clear from the foregoing description of the alternate embodiment that it basically differs from the first described embodiment in that the cartridge ink ribbon rewind gear is driven by the printer motor instead of being driven by the roller platen gear.

Obviously, many modifications and variations of the present invention are possible in the light of the above teachings. It is therefore understood that, within the scope of the appended claims, the invention may be practiced otherwise than specifically described.

What is claimed is:

1. A tape and ink ribbon supply cartridge for use in a label printer comprising:

a housing;

an ink ribbon supply spool having a supply of ink ribbon thereon and an ink ribbon rewind spool;

a tape supply spool having a supply of tape thereon; and a platen supported in said housing for advancing said ink ribbon and said tape.

2. A tape and ink ribbon supply cartridge as in claim 1 including means in said ribbon supply cartridge for engaging a drive means in the label printer when said cartridge is laterally inserted in the label printer.

3. A tape and ink ribbon supply cartridge as in claim 2 wherein said means for engaging the drive means includes a gear on said platen.

4. A tape and ink ribbon supply cartridge as in claim 1 including a notch in the cartridge housing for maintaining the cartridge in the label printer.

5. A tape and ink ribbon supply cartridge as in claim 4 wherein said notch is located in a sidewall of said cartridge housing.

6. A tape and ink ribbon supply cartridge as in claim 1 including means on said ribbon rewind spool for rotating said ribbon rewind spool to enable said ink ribbon to be wound on said rewind spool.

7. A tape and ink ribbon supply cartridge as in claim 6 wherein said rotating means on said ribbon rewind spool is a gear.

8. A tape and ink ribbon supply cartridge as in claim 1 wherein said ink ribbon and tape are positioned against said platen.

9. A tape and ink ribbon supply cartridge as in claim 6 including means on said platen for rotating said platen and for driving said ribbon rewind spool rotating means.

10. A tape and ink ribbon supply cartridge as in claim 9 wherein said means on said platen for rotating said platen is a gear.

11. A tape and ink ribbon supply cartridge as in claim 8 wherein said ink ribbon and tape are positioned against said platen adjacent a port opening in the cartridge housing.

12. A tape and ink ribbon supply cartridge as in claim 1 wherein said housing includes a cover and base and having means integral with said cover and means integral with said base for providing stability to said cartridge.

13. A tape and ink ribbon supply cartridge as in claim 12 wherein said means for providing stability to said housing includes telescoping members integral with said cover and base.

14. A tape and ink ribbon supply cartridge as in claim 13 wherein at least one of said telescoping members is a hub.

15. A tape and ink ribbon supply cartridge as in claim 14 wherein at least one of said telescoping members consists of a hub and post.

16. A tape and ink ribbon supply cartridge as in claim 15 wherein said hub is integral with the cover and said post is integral with the base.

17. A tape and ink ribbon supply cartridge as in claim 8 wherein said means on said ribbon rewind spool for rotating said ribbon rewind spool also rotates the platen for advancing the tape and ink ribbon

18. A tape and ink ribbon supply cartridge as in claim 17 wherein said ink ribbon and tape are positioned against said platen.

19. A tape and ink ribbon supply cartridge as in claim 18 wherein said ink ribbon and tape are positioned against said platen adjacent the opening in the cartridge housing.

20. A tape and ink ribbon supply cartridge as in claim 1 wherein said ink ribbon rewind spool is mounted on a forked hub.

21. A tape and ink ribbon supply cartridge as in claim 1 further comprising a step wall portion for use as a backing surface for engagement by a tape cutter mounted in the device for cutting the tape.

22. A tape and ink ribbon supply cartridge as in claim 21 wherein said housing includes a tape exit formed therein, and said step wall portion is located adjacent to said tape exit.

23. A tape and ink ribbon supply cartridge as in claim 21 wherein said step wall portion is located for engagement by the tape cutter when said cartridge is horizontally inserted in the device.

24. A tape and ink ribbon supply cartridge comprising:

a housing having an opening therein;

an ink ribbon supply spool having a supply of ink ribbon thereon and an ink ribbon rewind spool;

a tape supply spool having a supply of tape thereon;

means on said ink ribbon rewind spool for rotating said ribbon rewind spool to enable said ink ribbon to be wound on said rewind spool;

a platen for advancing said tape and said ink ribbon; and means on said platen for rotating said platen to advance said tape and ink ribbon and for driving said ribbon rewind spool rotating means.

25. A tape and ink ribbon supply cartridge as in claim 24 wherein said rotating means on said ribbon rewind spool is a gear.

26. A tape and ink ribbon supply cartridge as in claim 24 wherein said rotating means on said platen is a gear.

27. A tape and ink ribbon supply cartridge as in claim 24 wherein said ink ribbon and tape are positioned against said platen adjacent a port opening in the cartridge housing.

28. A tape and ink ribbon supply cartridge as in claim 24 wherein said housing includes a cover and base and having means integral with said cover and means integral with said base for providing stability to said cartridge.

29. A tape and ink ribbon supply cartridge as in claim 24 wherein said means for providing stability to said housing includes telescoping members integral with said cover and base.

30. A tape and ink ribbon supply cartridge as in claim 29 wherein at least one of said telescoping members is a hub.

31. A tape and ink ribbon supply cartridge as in claim 29 wherein at least one of said telescoping members consists of a hub and post.

32. A tape and ink ribbon supply cartridge as in claim 30 wherein said hub is integral with the cover and said post is integral with the base.

33. A tape and ink ribbon supply cartridge as in claim 24 wherein said ink ribbon rewind spool is mounted on a forked hub.

34. A tape and ink ribbon supply cartridge comprising:

a housing having an opening therein;

an ink ribbon supply spool having a supply of ink ribbon thereon and an ink ribbon rewind spool;

a tape supply spool having a supply of tape thereon;

a platen for advancing said tape and said ink ribbon;

means on said platen for rotating said platen to advance said tape and ink ribbon; and means on said ink ribbon rewind spool for rotating said ribbon rewind spool to enable said ink ribbon to be wound on said rewind spool and for driving said platen rotating means.

35. A tape and ink ribbon supply cartridge as in claim 34 wherein said rotating means on said ribbon rewind spool is a gear.

36. A tape and ink ribbon supply cartridge as in claim 34 wherein said rotating means on said platen is a gear.

37. A tape and ink ribbon supply cartridge as in claim 34 wherein said ink ribbon and tape are positioned against said platen adjacent the opening in the cartridge housing, 38. A tape and ink ribbon supply cartridge as in claim 34 wherein said housing includes a cover and base and having means integral with said cover and means integral with said base for providing stability to said cartridge.

39. A tape and ink ribbon supply cartridge as in claim 34 wherein said means for providing stability to said housing includes telescoping members integral with said cover and base.

40. A tape and ink ribbon supply cartridge as in claim 39 wherein at least one of said telescoping members is a hub.

41. A tape and ink ribbon supply cartridge as in claim 39 wherein at least one of said telescoping members consists of a hub and post.

42. A tape and ink ribbon supply cartridge as in claim 40 wherein said hub is integral with the cover and said post is integral with the base.

43. A tape and ink ribbon supply cartridge as in claim 34 wherein said ink ribbon rewind spool is mounted on a forked hub.

44. A label printer and a cartridge for use therein comprising means on said printer for latching the cartridge in the printer; and a print head in said printer for urging the cartridge out of said printer when said cartridge is unlatched.

45. A label printer and a cartridge as in claim 44 wherein said latching means on said printer includes an integrally formed abutment which is spring biased into a notch in the cartridge.

46. A label printer and a cartridge as in claim 45 wherein said latching means includes a finger formed activator for releasing said latching means from its latched position.

47. A label printer and a cartridge as in claim 44 wherein said print head is spring biased.

48. A label printer and a cartridge for use therein comprising:

a tape and ink ribbon in said cartridge;

a platen supported in said cartridge;

means on said platen for rotating said platen for advancing said tape and said ink ribbon;

drive means supported in said label printer;

means on said cartridge for enabling said cartridge to be laterally inserted in said label printer; and means on said label printer for enabling said cartridge to be laterally inserted in said label printer and for enabling said platen rotating means to engage said drive means for advancing said tape and said ink ribbon.

49. A label printer and a cartridge as in claim 48 wherein said cartridge is laterally inserted in the rear portion of said label printer.

50. A label printer and a cartridge for use therein comprising a cartridge including a platen for advancing a tape and an ink ribbon;

means on said platen for rotating said platen to advance said tape and ink ribbon; and means in said printer driving the means on said platen for advancing said tape and ink ribbon.

51. A label printer and cartridge as in claim 50 wherein said means in said printer driving the means on said platen is a gear.

52. A label printer and a cartridge as in claim 50 wherein said cartridge further comprises an ink supply spool having a supply spool of ink thereon, an ink ribbon rewind spool, and means on said rewind spool for rotating said ribbon rewind spool.

53. A label printer and a cartridge as in claim 52 wherein said means on said platen for rotating said platen also drives said ink ribbon rewind spool for rotating said ribbon rewind spool.

54. A label printer and a cartridge as in claim 52 wherein said means on said rewind spool for rotating said rewind spool is a gear.

55. A label printer and a cartridge as in claim 45 further comprising tape cutting means on said label printer for cutting the tape and wherein said cartridge includes a step wall portion for engagement by said tape cutting means for cutting the tape when said cartridge is horizontally inserted in said label printer.

56. A label printer and a cartridge for use therein comprising:

said cartridge including a tape, and ink ribbon, means for advancing said tape and ink ribbon, and rotating means for rotating said advancing means to advance said tape and ink ribbon; and drive means in said label printer to be engaged by said rotating means when said cartridge is laterally inserted in said label printer.

57. A label printer and a cartridge as in claim 56 wherein said rotating means is integral with said advancing means.

58. A label printer and a cartridge as in claim 56 wherein said cartridge is laterally inserted in the rear portion of said label printer.

* * * * *